US011550261B2

(12) United States Patent
Hiraya

(10) Patent No.: US 11,550,261 B2
(45) Date of Patent: Jan. 10, 2023

(54) TIMEPIECE

(71) Applicant: Seiko Epson Corporation, Tokyo (JP)

(72) Inventor: Eiichi Hiraya, Shiojiri (JP)

(73) Assignee: SEIKO EPSON CORPORATION

( * ) Notice: Subject to any disclaimer, the term of this patent is extended or adjusted under 35 U.S.C. 154(b) by 435 days.

(21) Appl. No.: 16/787,116

(22) Filed: Feb. 11, 2020

(65) Prior Publication Data

US 2020/0257246 A1 Aug. 13, 2020

(30) Foreign Application Priority Data

Feb. 12, 2019 (JP) ..... JP2019-022414

(51) Int. Cl.
*G04B 13/02* (2006.01)
*G04B 3/04* (2006.01)
*G04B 1/16* (2006.01)

(52) U.S. Cl.
CPC ..... *G04B 13/02* (2013.01); *G04B 1/16* (2013.01); *G04B 3/04* (2013.01)

(58) Field of Classification Search
CPC ..... G04B 13/02; G04B 1/16; G04B 3/04
USPC ..... 368/66
See application file for complete search history.

(56) References Cited

U.S. PATENT DOCUMENTS

| | | | | |
|---|---|---|---|---|
| 4,363,553 | A | 12/1982 | Thomi et al. | |
| 2007/0041277 | A1 | 2/2007 | Gerber et al. | |
| 2018/0164743 | A1* | 6/2018 | Villar | G04B 9/005 |
| 2018/0284696 | A1* | 10/2018 | Bazin | G04B 1/12 |

FOREIGN PATENT DOCUMENTS

| | | | |
|---|---|---|---|
| CH | 713583 | A2 * | 9/2018 |
| CN | 201654475 | U | 11/2010 |
| CN | 206331250 | U | 7/2017 |
| JP | 2001-221867 | A | 8/2001 |
| JP | 2007-506940 | A | 3/2007 |
| JP | 2018-096976 | A | 6/2018 |

* cited by examiner

*Primary Examiner* — Edwin A. Leon
*Assistant Examiner* — Kevin Andrew Johnston
(74) *Attorney, Agent, or Firm* — Harness, Dickey & Pierce, P.L.C.

(57) ABSTRACT

A timepiece having multiple springs while reducing the plane size of the movement. The timepiece has a first barrel including a first barrel arbor, a first spring, and a first barrel wheel; and a second barrel including a second barrel arbor, a second spring, and a second barrel wheel, disposed to a position not superimposed with the first barrel in a plan view from the axial direction of the first barrel arbor and the second barrel arbor, and having rotation of the first barrel transferred thereto; a planetary gear mechanism having a display pivot that turns in a first direction when rotation of the first ratchet wheel that turns in unison with the first barrel arbor is transferred, and turns in a second direction opposite the first direction when rotation of the second barrel wheel is transferred, and is disposed to a position not superimposed with the first barrel and the second barrel in plan view; and a power reserve wheel train including multiple wheels that transfer rotation of the first ratchet wheel to the planetary gear mechanism, and having one of the multiple wheels axially supported by the second barrel arbor.

7 Claims, 9 Drawing Sheets

TIMEPIECE

The present application claims priority based on and incorporates by reference the entire contents of Japanese Patent Application No. 2019-022414 filed on Feb. 12, 2019.

BACKGROUND

1. Technical Field

The present disclosure relates to a timepiece that has multiple barrels.

2. Related Art

JP-A-2018-96976 describes a movement for a mechanical timepiece that has multiple barrel systems and a power reserve indicator. This mechanical timepiece movement has a differential gear connected to both the winding output and the unwinding output of the barrel system. The differential gear has a crown, a chassis gear coaxial to the crown, and a sun pinion. The power reserve indicator is configured by the sun pinion and an indicator affixed to the arbor of the sun pinion.

In a plan view seen along the axial direction of the barrel system in JP-A-2018-96976, the differential gear with the sun pinion is superimposed with the barrel system. The barrel system and the differential gear are parts whose thickness is large compared with other parts of the movement, and therefore increase the thickness of the movement.

If the differential gear is located at a position in plan view not superimposed with the barrel system in order to not increase the thickness of the movement, the wheels between the barrel system and the differential gear must also be located at positions in plan view not superimposed with the barrel system, thus increasing the plane size of the movement.

SUMMARY

A timepiece according to the disclosure has: a first barrel including a first barrel arbor, a first spring, and a first barrel wheel; a second barrel including a second barrel arbor, a second spring, and a second barrel wheel, disposed to a position not superimposed with the first barrel in a plan view from the axial direction of the first barrel arbor and the second barrel arbor, and having rotation of the first barrel transferred thereto; a planetary gear mechanism having a display pivot that turns in a first direction when rotation of a wheel that turns in unison with the first barrel arbor is transferred thereto, and turns in a second direction opposite the first direction when rotation of the second barrel wheel is transferred thereto, and is disposed to a position not superimposed with the first barrel and the second barrel in plan view; and a power reserve wheel train including multiple wheels that transfer rotation of a wheel that turns in unison with the first barrel arbor to the planetary gear mechanism, and having one of the multiple wheels axially supported by the second barrel arbor.

In a timepiece according to another aspect of the disclosure, the planetary gear mechanism includes a first sun wheel including the display pivot and a first sun gear that rotates in unison with the display pivot; a second sun wheel of which the pivot is the display pivot, and which has a second sun gear to which rotation of a wheel that turns in unison with the first barrel arbor is transferred, and a second sun pinion that rotates in unison with the second sun gear; an intermediate planetary gear of which the pivot is the display pivot and to which rotation of the second barrel wheel is transferred; a planetary gear that is supported pivotably to the intermediate planetary gear on a pivot disposed eccentrically to the pivot of the intermediate planetary gear, and meshes with the second sun pinion, and a planetary pinion that meshes with the first sun gear; and the power reserve wheel train including a winding indicator wheel train having multiple wheels that transfer rotation of a wheel that turns in unison with the first barrel arbor to the second sun gear, one of the multiple wheels supported by the second barrel arbor, and an unwinding indicator wheel train including multiple wheels that transfer rotation of the second barrel wheel to the intermediate planetary wheel.

In an electronic timepiece according to another aspect of the disclosure, the second barrel arbor is also used as a pivot of a part other than one wheel.

In an electronic timepiece according to another aspect of the disclosure, the second barrel is disposed between the first barrel and the planetary gear mechanism.

In an electronic timepiece according to another aspect of the disclosure, wheels of the power reserve wheel train that are superimposed in plan view with the first barrel or the second barrel are not superimposed with each other in plan view.

An electronic timepiece according to another aspect of the disclosure also has a main plate that axially supports the first barrel arbor and the second barrel arbor; and a winding stem disposed freely rotatably to the main plate; the first barrel and the second barrel being disposed in one of two areas of the main plate divided in plan view along the axial direction of the winding stem.

An electronic timepiece according to another aspect of the disclosure also has a wheel train that is driven by the second barrel wheel; a generator that is driven by the wheel train produces induced electromotive force, and outputs electrical energy; and an indicator attached to the wheel train; and the generator is disposed in the other of the two areas of the main plate divided in plan view along the axial direction of the winding stem.

Other objects and attainments together with a fuller understanding of the disclosure will become apparent and appreciated by referring to the following description and claims taken in conjunction with the accompanying drawings.

DESCRIPTION OF EMBODIMENTS

Embodiment

A timepiece 1 according to a preferred embodiment of the disclosure is described below with reference to FIG. 1 to FIG. 8.

Figure 1:
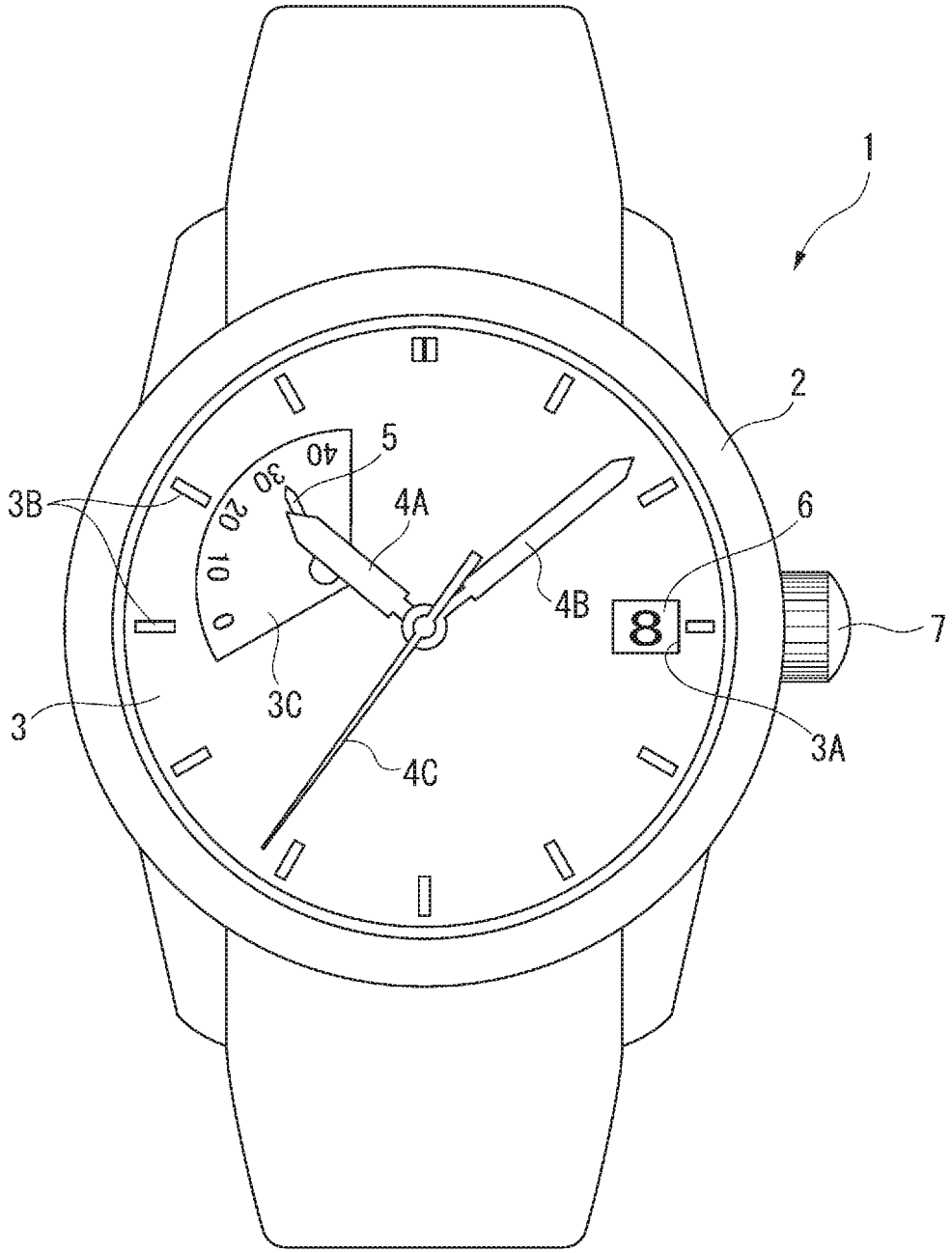
FIG. 1 is a front view of a timepiece according to an embodiment.

FIG. 1 is a front view of the timepiece 1. In this embodiment the timepiece 1 is a wristwatch that is worn on the wrist of the user, and has a round tubular external case 2, and a dial 3 disposed on the inside circumference side of the external case 2. Of the two openings to the external case 2, the opening on the front (dial) side is covered by a crystal, and the opening on the back side is covered by a back cover.

Figure 2:
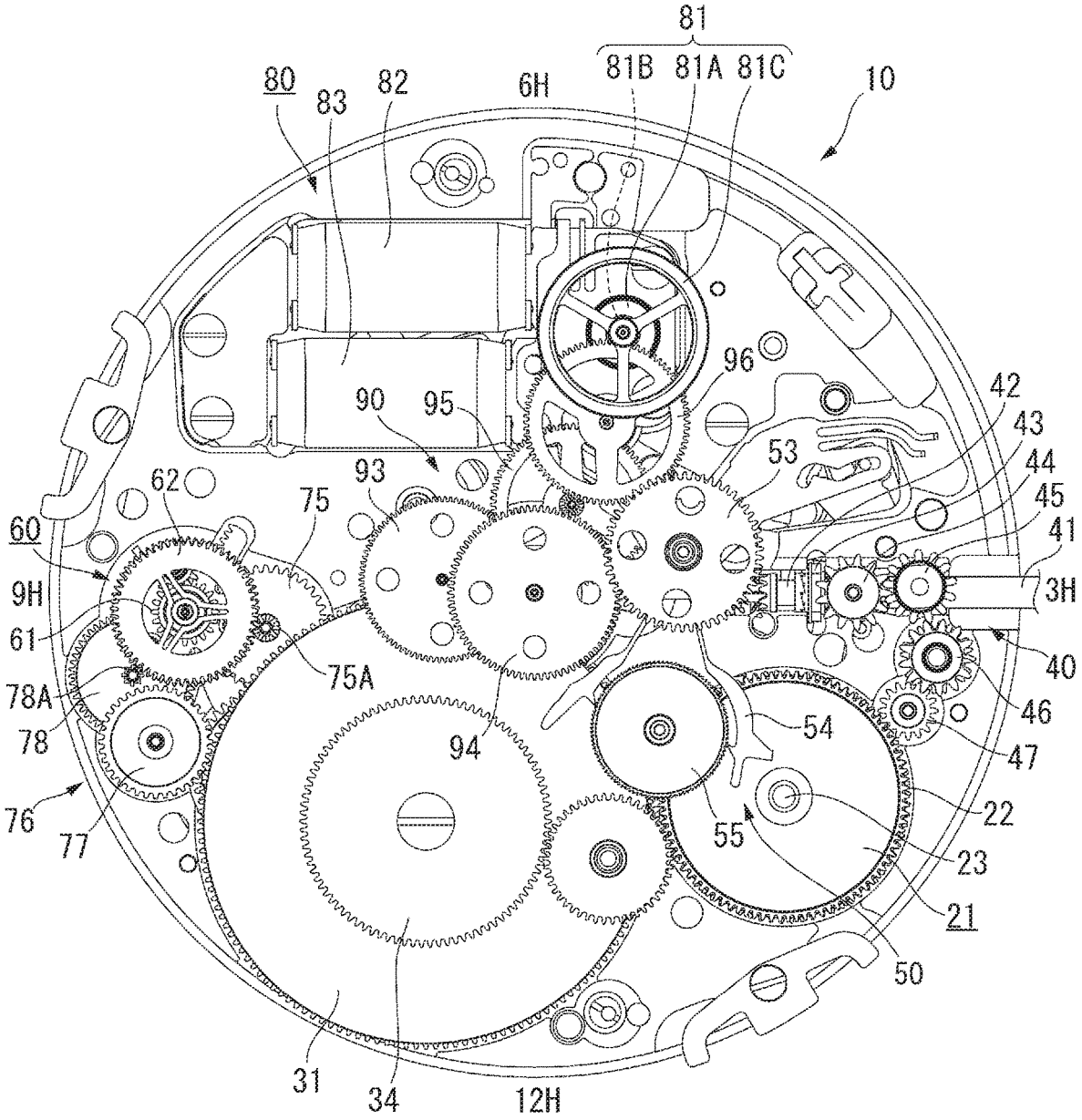
FIG. 2 is a plan view showing main parts of the movement of a timepiece according to an embodiment.

The timepiece 1 includes the movement 10 shown in FIG. 2 housed inside the external case 2, an hour hand 4A, minute hand 4B, and second hand 4C for indicating the time as shown in FIG. 1, and a power reserve indicator 5 for indicating the reserve power. A calendar window 3A is also formed in the dial 3, and a date indicator 6 can be seen through the calendar window 3A. Hour markers 3B for indicating time, and a fan-shaped subdial 3C on which the power reserve indicator 5 indicates the reserve power, are also disposed to the dial 3.

A crown 7 is disposed in the side of the external case 2. The crown 7 can be pulled out and moved from the 0 stop position at which the crown 7 is pushed toward the center of the timepiece 1, to a first stop and a second stop.

When the crown 7 is turned at the 0 stop, a first spring 20 and a second spring 30 disposed in the movement 10 and described below can be wound. The power reserve indicator 5 moves in conjunction with winding the first spring 20 and a second spring 30. When the first spring 20 and second spring 30 are fully wound in the timepiece 1 according to this embodiment, a duration time of approximately 40 hours can be assured.

When the crown 7 is pulled out to the first stop and wound, the date indicator 6 moves and the date can be adjusted. When the crown 7 is pulled to the second stop, the second hand 4C stops, and when the crown 7 is turned at the second stop, the hour hand 4A and minute hand 4B move and the time can be set. Adjusting the date indicator 6, hour hand 4A, and minute hand 4B by means of the crown 7 is the same as with a conventional mechanical timepiece, and further description thereof is omitted.

Movement

Figure 3:
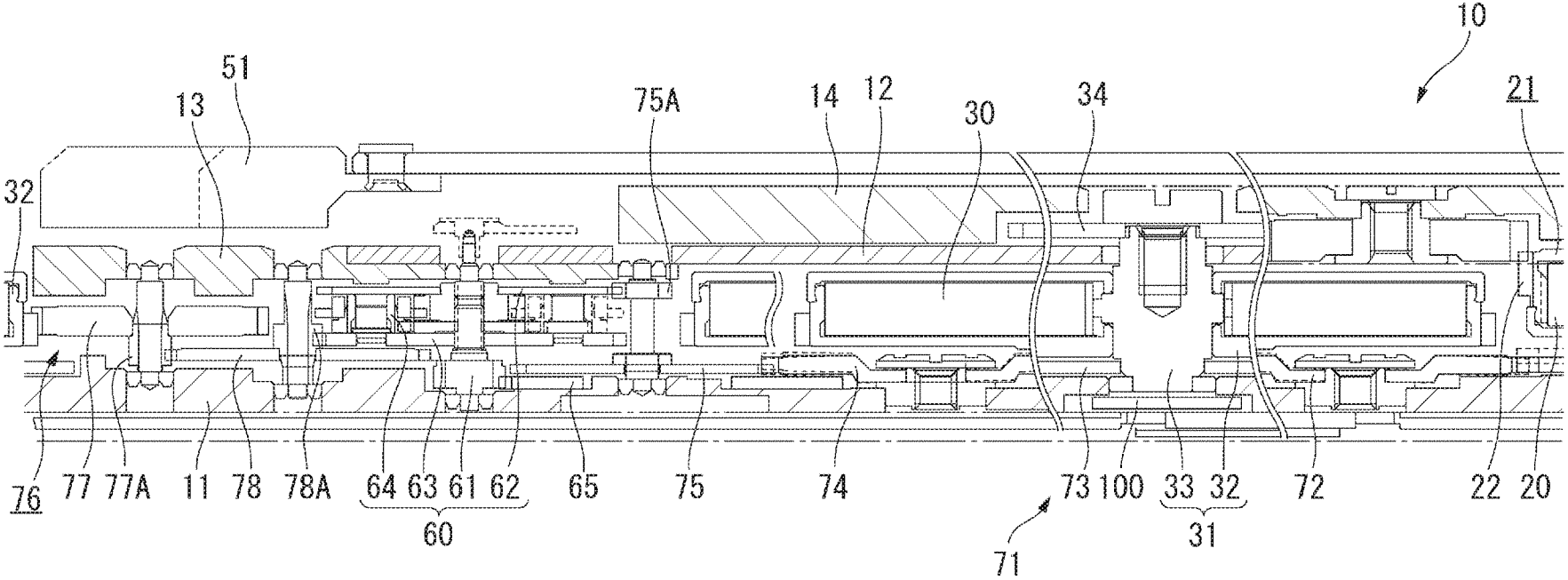
FIG. 3 is a plan view showing main parts of the movement of a timepiece according to an embodiment.
Figure 4:
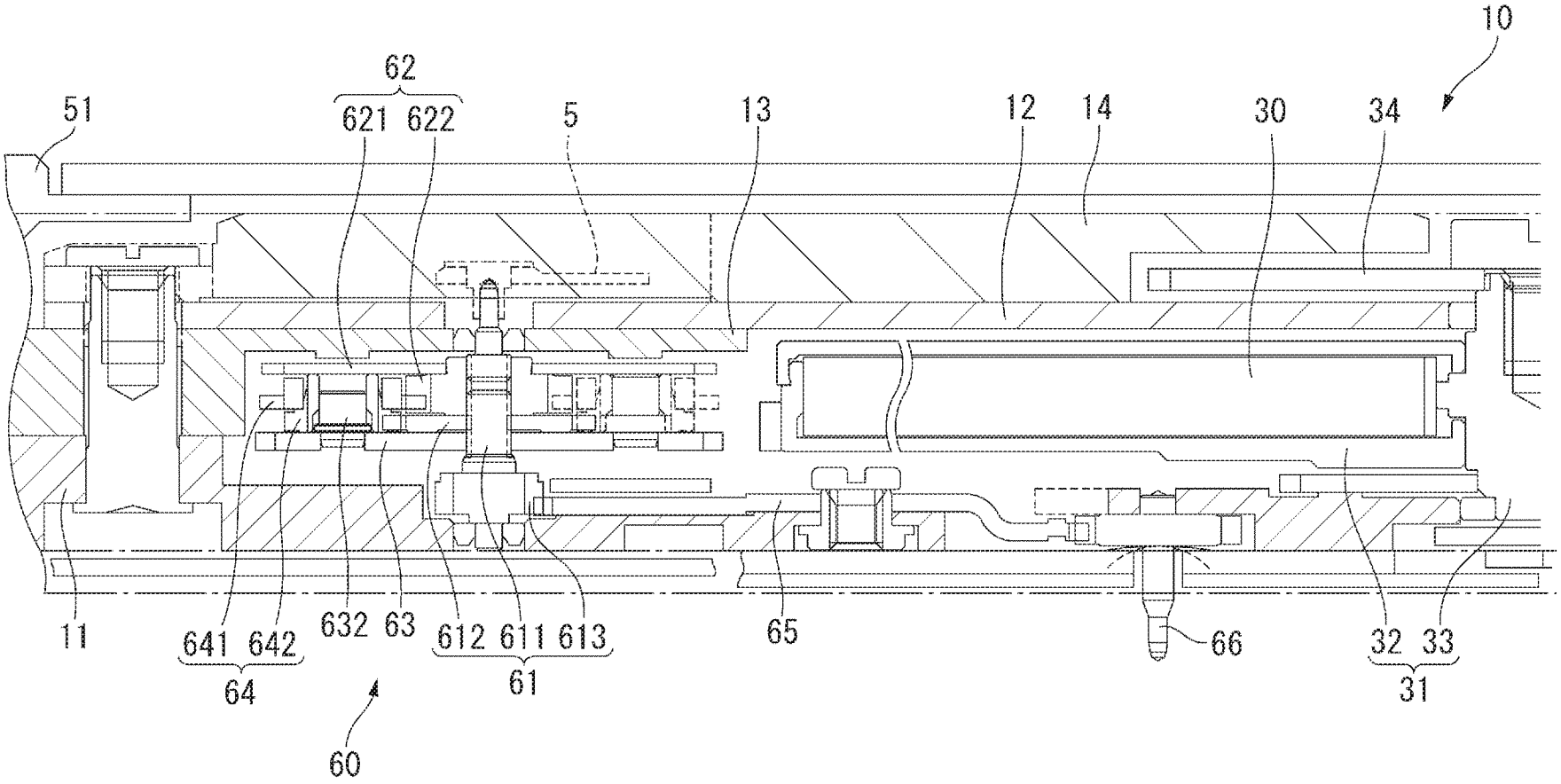
FIG. 4 is a plan view showing main parts of the movement of a timepiece according to an embodiment.
Figure 5:
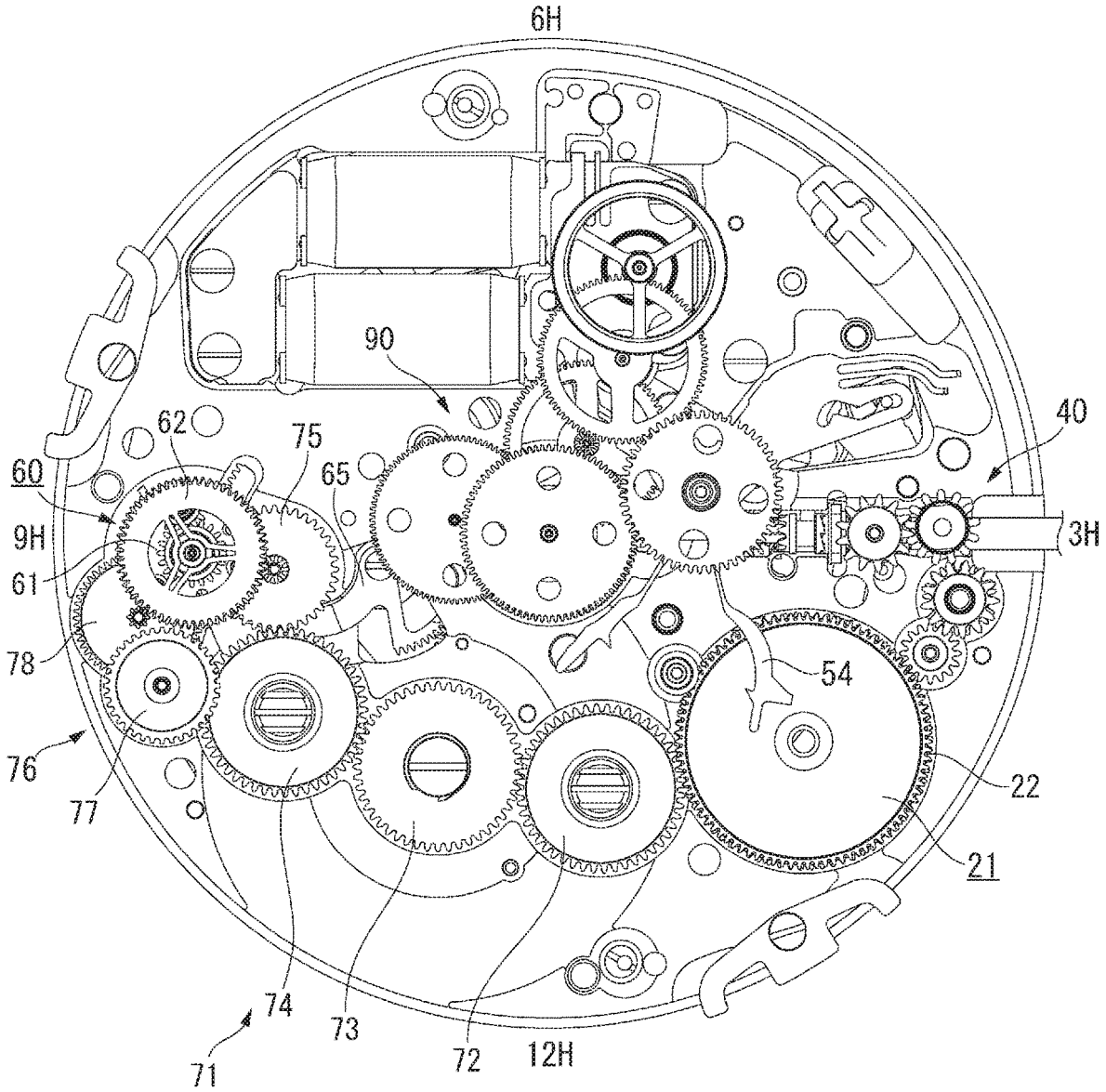
FIG. 5 is a plan view showing main parts of the movement of a timepiece according to an embodiment.
Figure 6:
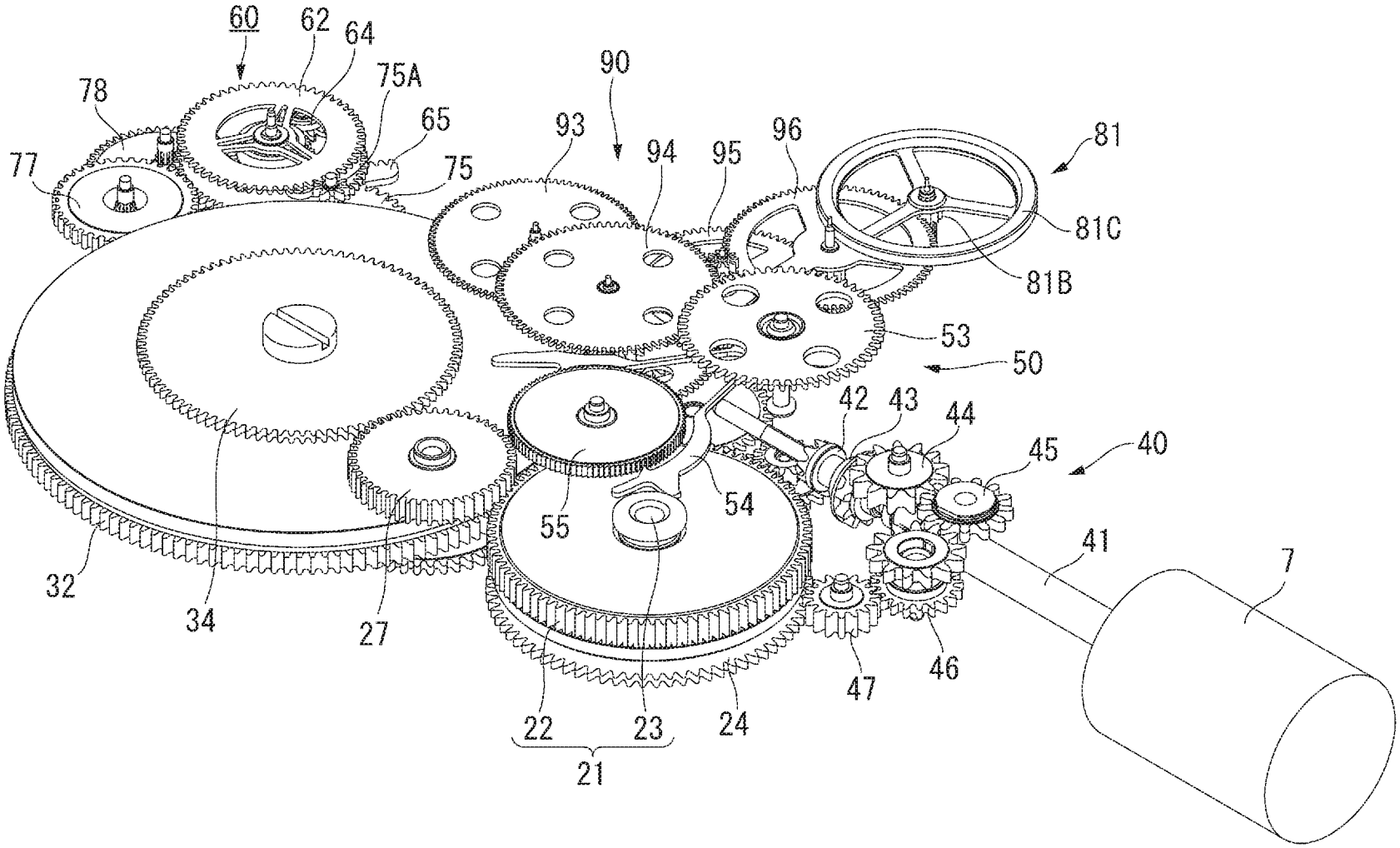
FIG. 6 is a plan view showing main parts of the movement of a timepiece according to an embodiment.
Figure 7:
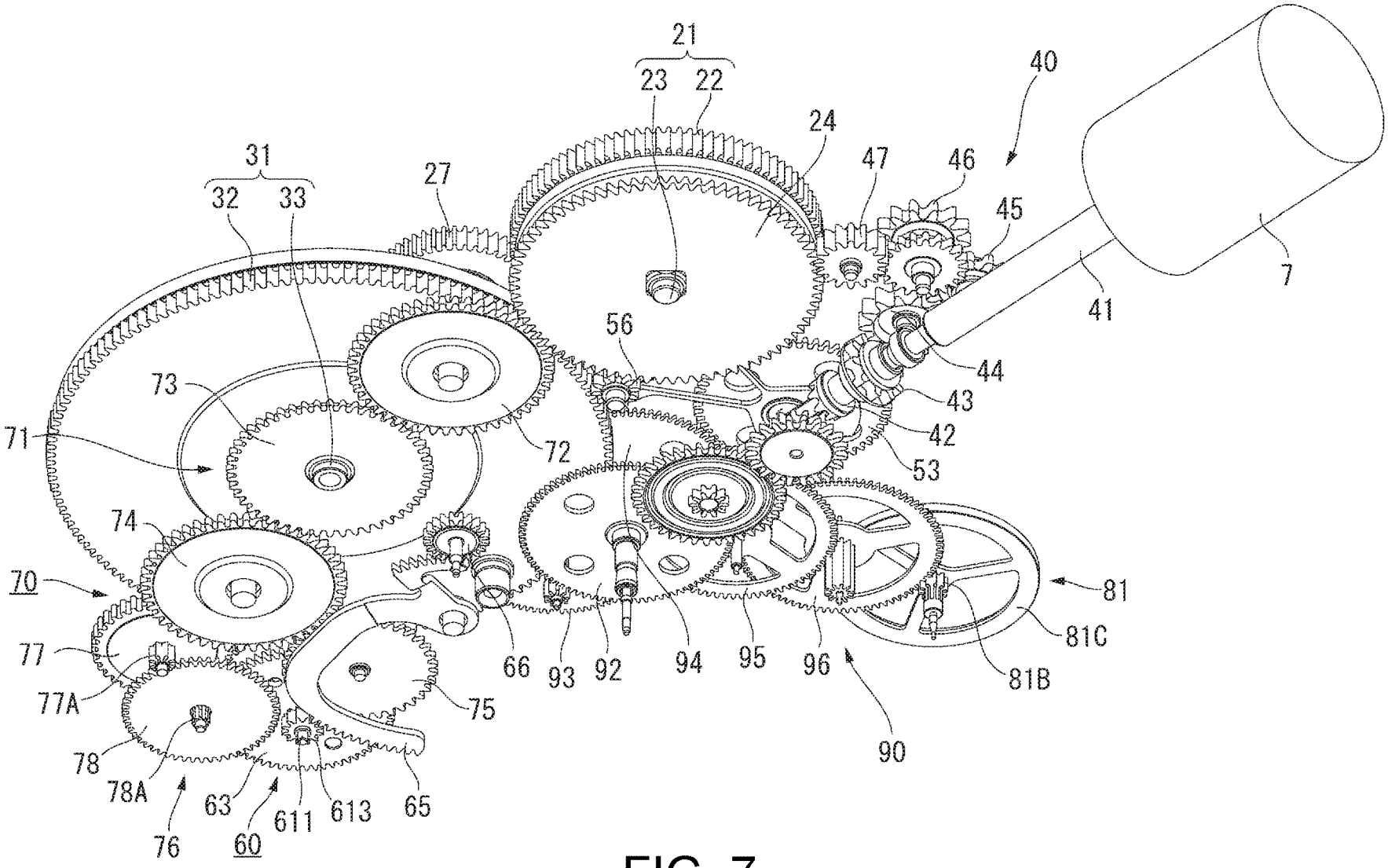
FIG. 7 is a plan view showing main parts of the movement of a timepiece according to an embodiment.
Figure 8:
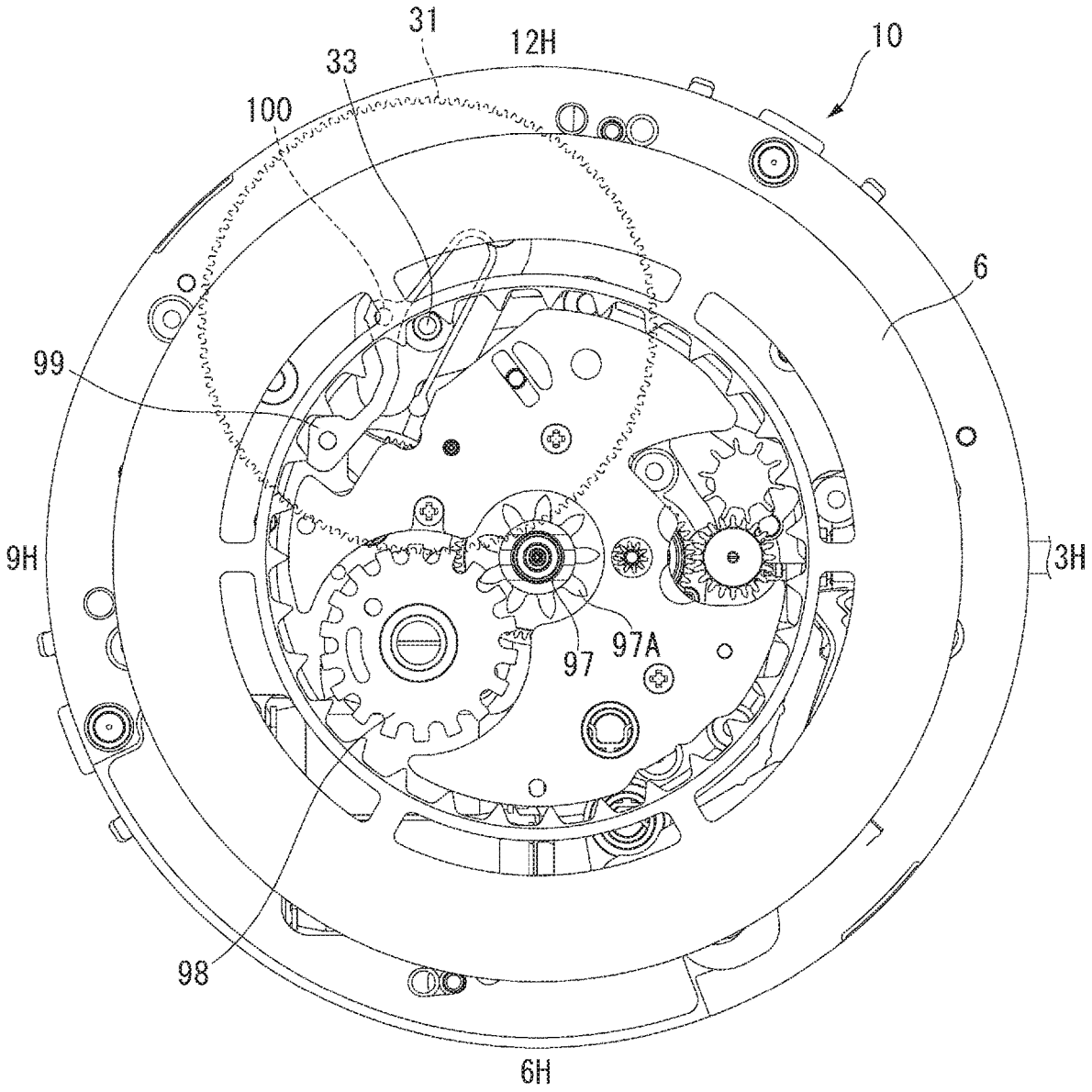
FIG. 8 is a plan view showing main parts of the movement of a timepiece according to an embodiment.

The movement 10 is described next with reference to FIG. 2 to FIG. 8. Note that FIG. 2 is a plan view showing main parts of the movement 10 from the back cover side, FIG. 3 and FIG. 4 are section views of main parts of the movement 10, and FIG. 5 is a plan view omitting the first spring 20 and the second spring 30 shown in FIG. 2. FIG. 6 and FIG. 7 are perspective views of main parts of the movement 10, and FIG. 8 is a plan view of main parts of the movement 10 from the dial side.

As shown in FIG. 2 and FIG. 3, the movement 10 includes a first barrel 21 in which the first spring 20 is held, and a second barrel 31 in which the second spring 30 is held. As described below, the hour hand 4A, minute hand 4B, second hand 4C, and power reserve indicator 5 are attached to pivots in the movement 10, and are driven by the first spring 20 and the second spring 30 of the movement 10.

The movement 10 includes a main plate 11, a first bridge 12, a second bridge 13, and a train bridge 14.

The first barrel 21 in which the first spring 20 is held, the second barrel 31 in which the second spring 30 is held, and a manual winding mechanism 40 and an automatic winding mechanism 50 for winding the first spring 20 and the second spring 30 are disposed between the main plate 11 and the train bridge 14.

A power reserve display mechanism for indicating the reserve power of the first spring 20 and the second spring 30, a wheel train 90 that transfers torque from the first spring 20 and the second spring 30, and a generator 80 that is driven by torque transferred through the wheel train 90, are also disposed between the main plate 11 and train bridge 14.

First Spring and First Barrel

The first spring 20 is housed inside the first barrel 21. The first barrel 21 includes a first barrel wheel 22, and a first barrel arbor 23. As shown in FIG. 6 and FIG. 7, a first ratchet wheel 24 that turns in unison with the first barrel arbor 23 is attached to the first barrel arbor 23.

Manual Winding Mechanism

As shown in FIG. 2, FIG. 6, and FIG. 7, the manual winding mechanism 40 includes a winding stem 41, sliding pinion 42, winding pinion 43, crown wheel 44, first intermediate ratchet wheel 45, second intermediate ratchet wheel 46, and third intermediate ratchet wheel 47. The third intermediate ratchet wheel 47 meshes with the first ratchet wheel 24.

The winding stem 41 and sliding pinion 42 therefore turn when the user winds the crown 7 at the 0 stop. When the crown 7 is at the 0 stop, the sliding pinion 42 engages the winding pinion 43, and rotation of the sliding pinion 42 is transferred sequentially from the winding pinion 43 to the crown wheel 44, first intermediate ratchet wheel 45, second intermediate ratchet wheel 46, and third intermediate ratchet wheel 47. As a result, the first ratchet wheel 24 and the first barrel arbor 23 turn, and the first spring 20 is wound.

Automatic Winding Mechanism

The automatic winding mechanism 50 includes a rotor 51 shown in FIG. 3, a bearing not shown that rotatably supports the rotor 51 and has a gear on the outer race that turns in unison with the rotor 51, an eccentric wheel 53 shown in FIG. 2 that meshes with the gear of the bearing, a pawl lever 54, and a transmission wheel 55.

The eccentric wheel 53 turns in both forward and reverse directions in response to rotation of the rotor 51. The pawl lever 54 is attached freely rotatably to the eccentric wheel 53 by a pivot disposed eccentrically to the pivot of the eccentric wheel 53.

When the eccentric wheel 53 turns in conjunction with the rotor 51, the pawl lever 54 attached to the eccentric wheel 53 moves back and forth toward and away from the transmission wheel 55, and turns the transmission wheel 55 in one direction. A second transmission wheel 56 that meshes with the first ratchet wheel 24 as shown in FIG. 7 is disposed in unison with the transmission wheel 55, and the first ratchet wheel 24 turns in conjunction with rotation of the second transmission wheel 56. When the first ratchet wheel 24 turns, the first barrel arbor 23 turns in unison with the first ratchet wheel 24, and the first spring 20 is wound.

The first spring 20 of the timepiece 1 according to this embodiment can therefore be both wound manually by operating the crown 7, and wound automatically by rotation of the rotor 51.

Second Spring and Second Barrel

As shown in FIG. 3 and FIG. 4, the second spring 30 is housed in the second barrel 31. The second barrel 31 includes a second barrel wheel 32, and a second barrel arbor 33. The second barrel arbor 33 can turn in unison with a second ratchet wheel 34.

The second spring 30 is wound by the first spring 20. More specifically, when the first spring 20 is wound and stores torque sufficient to wind the second spring 30, the first barrel wheel 22 of the first barrel 21 turns. The first barrel wheel 22 engages the second ratchet wheel 34 of the second barrel 31 through an intermediate barrel wheel 27, and when the first barrel wheel 22 turns, the second ratchet wheel 34 and the second barrel arbor 33 turn, and the second spring 30 is wound.

Therefore, the first spring 20 and the second spring 30 of the timepiece 1 according to this embodiment can be wound by both the manual winding mechanism 40 and the automatic winding mechanism 50.

Note that the timepiece 1 may also comprise only one of the manual winding mechanism 40 and the automatic winding mechanism 50.

The first barrel 21 and the second barrel 31 are disposed in one of two areas virtually separating the main plate 11 in the axial direction of the winding stem 41 into two parts. The axial direction of the winding stem 41 extends in the direction between the 3:00 and 9:00 hour markers 3B on the dial 3, and the main plate 11 is virtually divided into two areas on the 12:00 and 6:00 sides of the winding stem 41. In the timepiece 1 according to this embodiment, the first barrel 21 and second barrel 31 are disposed in the area on the 12:00 side.

Power Reserve Display Mechanism

The timepiece 1 also has a power reserve display mechanism that indicates the duration time (power reserve) of the the drive power source, that is, the first spring 20 and the second spring 30. The power reserve display mechanism includes a planetary gear mechanism 60, a power reserve wheel train 70, the subdial 3C disposed to the dial 3 as shown in FIG. 1, and the power reserve indicator 5. Numbers indicating the duration time are printed on the subdial 3C.

As shown in FIG. 2, the second barrel 31 is disposed in plan view between the first barrel 21 and the planetary gear mechanism 60. Note that herein a plan view means a view as seen in the axial direction of the first barrel arbor 23 and second barrel arbor 33, and a side view means a view from the direction perpendicular to the axial direction of the first barrel arbor 23 and second barrel arbor 33.

As shown in FIG. 7, the power reserve wheel train 70 includes a winding indicator wheel train 71, and an unwinding indicator wheel train 76.

The winding indicator wheel train 71 includes a first planetary transmission wheel 72, a barrel planetary transmission wheel 73, a second planetary transmission wheel 74, and a third planetary transmission wheel 75. The first planetary transmission wheel 72 meshes with the first ratchet wheel 24, and when the first ratchet wheel 24 is turned by the manual winding mechanism 40 or automatic winding mechanism 50, the first planetary transmission wheel 72 turns in conjunction with the first ratchet wheel 24, first planetary transmission wheel 72, barrel planetary transmission wheel 73, second planetary transmission wheel 74, and third planetary transmission wheel 75.

As shown in FIG. 2 and FIG. 3, a pinion 75A that engages the planetary gear mechanism 60 is disposed to the pivot of the third planetary transmission wheel 75.

The first planetary transmission wheel 72 and second planetary transmission wheel 74 are disposed freely rotatably on pivot members affixed to the main plate 11.

The third planetary transmission wheel 75 is axially supported freely rotatably by the main plate 11 and second bridge 13.

The barrel planetary transmission wheel 73 is supported freely rotatably by the second barrel arbor 33 of the second barrel 31 as shown in FIG. 3 and FIG. 7.

The first planetary transmission wheel 72, barrel planetary transmission wheel 73, and second planetary transmission wheel 74 are disposed at positions superimposed in plan view with the second barrel 31. As a result, the first planetary transmission wheel 72, barrel planetary transmission wheel 73, and second planetary transmission wheel 74 are not superimposed with each other in plan view.

As shown in FIG. 2, FIG. 3, and FIG. 7, the unwinding indicator wheel train 76 includes a fourth planetary transmission wheel 77, and a fifth planetary transmission wheel 78. The fourth planetary transmission wheel 77 has a pinion 77A that meshes with the fifth planetary transmission wheel 78, and the fifth planetary transmission wheel 78 has a pinion 78A that meshes with the planetary gear mechanism 60. The fourth planetary transmission wheel 77 meshes with the second barrel wheel 32, and when the second barrel wheel 32 turns, the fourth planetary transmission wheel 77 and fifth planetary transmission wheel 78 turn in unison with the second barrel wheel 32.

The fourth planetary transmission wheel 77 and fifth planetary transmission wheel 78 are axially supported freely rotatably by the main plate 11 and second bridge 13.

The planetary gear mechanism 60 includes a first sun wheel 61, a second sun wheel 62, an intermediate planetary wheel 63, and a planetary wheel 64 supported freely rotatably on the intermediate planetary wheel 63.

The first sun wheel 61 has a display pivot 611 axially supported freely rotatably by the main plate 11, and a first sun gear 612 affixed to the display pivot 611. A pinion 613 is formed in unison with the display pivot 611, and the power reserve indicator 5 is attached to a winding indicator wheel 66 that is turned through a rack-like winding indicator intermediate gear 65 that meshes with the pinion 613 and is supported to move back and forth on the main plate 11.

More specifically, the winding indicator wheel 66 is axially supported freely rotatably on the main plate 11, the pivot of the winding indicator wheel 66 protrudes through the dial 3 to the surface of the dial 3, and the power reserve indicator 5 is attached to the pivot.

Note that as indicated by the dotted line in FIG. 3, the power reserve indicator 5 may be attached to the end of the display pivot 611 on the back cover side. In this case, the power reserve indicator 5 can be seen from the back cover side by providing a glass or other type of window in the back cover.

The power reserve indicator 5 is therefore configured to rotate in conjunction with rotation of the first sun wheel 61.

The second sun wheel 62 has a second sun gear 621, and a second sun pinion 622 affixed to the second sun gear 621. The second sun pinion 622 is axially supported freely rotatably on the display pivot 611, and the second sun wheel 62 is thereby disposed freely rotatably coaxially to the first sun wheel 61. The second sun gear 621 meshes with the pinion 75A of the third planetary transmission wheel 75.

The intermediate planetary wheel 63 is axially supported freely rotatably on the display pivot 611, and is coaxial to the first sun wheel 61 and second sun wheel 62. Teeth that mesh with the pinion 78A of the fifth planetary transmission wheel 78 are formed on the outside of the intermediate planetary wheel 63. A pin-shaped pivot 632 is affixed at a position eccentric to the pivot of the intermediate planetary wheel 63.

The planetary wheel 64 includes a planetary gear 641, and a planetary pinion 642 affixed in unison with the planetary gear 641, and is axially supported freely rotatably on the pivot 632 of the intermediate planetary wheel 63.

The planetary gear 641 meshes with the second sun pinion 622, and the planetary pinion 642 meshes with the first sun gear 612.

Operation of the Power Reserve Display Mechanism

Operation of the power reserve display mechanism described above when the first spring 20 and the second spring 30 wind and unwind is described next.

When the first ratchet wheel 24 is turned by the manual winding mechanism 40 or automatic winding mechanism 50, the first barrel arbor 23 turns and the first spring 20 is wound. As the first barrel arbor 23 turns, the first planetary transmission wheel 72, barrel planetary transmission wheel 73, second planetary transmission wheel 74, and third planetary transmission wheel 75 of the winding indicator wheel train 71 turn, and torque is transferred to the second sun wheel 62, planetary wheel 64, and first sun wheel 61.

Because rotation of the second barrel wheel 32 of the second barrel 31 is slow and substantially stopped when the first spring 20 is being wound and until the second spring 30 is fully wound by the first spring 20, the fourth planetary transmission wheel 77 and fifth planetary transmission wheel 78 of the unwinding indicator wheel train 76 are stopped, and the intermediate planetary wheel 63 that meshes with the pinion 78A of the fifth planetary transmission wheel 78 is also stopped.

As a result, the planetary wheel 64 supported by the pivot 632 of the intermediate planetary wheel 63 rotates, and causes the first sun wheel 61 and display pivot 611 to turn in a first direction. When the first sun wheel 61 and display pivot 611 turn in the first direction, the winding indicator wheel 66 is turned through the winding indicator intermediate gear 65, and the power reserve indicator 5 turns clockwise, that is, in the direction increasing the duration time indicated on the subdial 3C.

When the first spring 20 and the second spring 30 unwind, the first ratchet wheel 24 and winding indicator wheel train 71 are stopped, and the second sun wheel 62 therefore also stops.

When the second barrel wheel 32 turns due to the second spring 30 unwinding, torque is transferred through the fourth planetary transmission wheel 77 and fifth planetary transmission wheel 78 of the unwinding indicator wheel train 76 to the intermediate planetary wheel 63. Because the second sun pinion 622 meshed with the planetary gear 641 of the planetary wheel 64 is stopped when the intermediate planetary wheel 63 turns, the planetary wheel 64 rotates on its axis while revolving around the second sun pinion 622. As a result, the first sun gear 612 meshed with the planetary wheel 64 rotates in a second direction, which is the opposite direction as when the first spring 20 and the second spring 30 are wound.

When the first sun gear 612 turns in the second direction, the display pivot 611 also turns in the second direction, rotation is transferred through the winding indicator intermediate gear 65 to the winding indicator wheel 66, and the power reserve indicator 5 turns in the counterclockwise, that is, the opposite direction as during winding.

Generator

As shown in FIG. 2 and FIG. 7, a generator 80 is configured by a rotor 81 and coil blocks 82 and 83.

The rotor 81 includes a rotor magnet 81A, a rotor pinion 81B, and a rotor inertial disk 81C. The rotor inertial disk 81C reduces variation in the speed of rotor 81 rotation due to variation in the drive torque from the second barrel wheel 32. The coil blocks 82 and 83 are each configured by a coil winding on a core.

When the rotor 81 turns due to an external torque, induced electromotive force is produced by the coil blocks 82 and 83, and the generator 80 outputs electrical energy to an IC chip, for example. A brake can be applied to the rotor 81 by shorting the coil, and by controlling the braking force, the rotational period of the rotor 81 can be kept constant.

When the main plate 11 is divided into a 12:00 side and a 6:00 side, the generator 80 is disposed on the 6:00 side, that is, a different side as the 12:00 side where the first barrel 21 and second barrel 31 are disposed.

Wheel Train

The wheel train 90 that drives the hour hand 4A, minute hand 4B, and second hand 4C by mechanical energy from the first spring 20 and the second spring 30 is described next.

As shown in FIG. 2, FIG. 5, FIG. 6, and FIG. 7, the wheel train 90 includes a center wheel 92, third wheel 93, fourth wheel 94, fifth wheel 95, and sixth wheel 96. Rotation of the second barrel wheel 32 is transferred and sequentially accelerated through the center wheel 92, third wheel 93, fourth wheel 94, fifth wheel 95, and sixth wheel 96, and transferred to the rotor 81.

The minute hand 4B is attached through a minute wheel not shown to the center wheel 92, and the second hand 4C is attached to the fourth wheel 94. The hour wheel 97 shown in FIG. 8 is connected to the minute wheel through the minute wheel and pinion not shown, and the hour hand 4A is attached to the hour wheel 97.

A intermediate date wheel 97A is attached to the hour wheel 97, and a date finger that pushes the date indicator 6 is attached to the date indicator driving wheel 98 that is turned by the intermediate date wheel 97A.

A date jumper 99 that suppresses play in the date indicator 6 is engaged with the internal teeth of the date indicator 6. In this embodiment of the disclosure, the date jumper 99 is supported pivotably by a pivot member 100 disposed to the main plate 11.

The AC output of the generator 80 in this timepiece 1 is boosted, rectified, and charged to a smoothing capacitor by a rectifier circuit configured by a boost rectifier, full-wave rectifier, half-wave rectifier, or transistor rectifier, for example, and power from the capacitor drives a rotation control circuit not shown that controls the rotational period of the generator 80. The rotation control circuit is configured by an integrated circuit including, for example, an oscillator circuit, frequency divider, rotation detection circuit, rotation comparison circuit, and electromagnetic brake control means, for example, and a crystal oscillator is used for the oscillator circuit.

Effects of this Embodiment

Because the second barrel arbor 33 of the second barrel 31 in the timepiece 1 according to this embodiment is also used as the pivot of the barrel planetary transmission wheel 73 in the winding indicator wheel train 71, the plane and sectional layouts of the movement 10 can be configured more efficiently, and the size of the movement 10 can be reduced. The freedom of design of the timepiece 1 can therefore be improved, and a timepiece 1 with an excellent aesthetic design can be provided.

For example, when the pivot of the barrel planetary transmission wheel 73 is disposed to a position not superimposed with the second barrel arbor 33 in plan view, a layout in which the second barrel arbor 33 and the barrel planetary transmission wheel 73 do not interfere with each other is needed, and the size of the movement 10 increases. However, because the second barrel arbor 33 is also used as the pivot of the barrel planetary transmission wheel 73 in the timepiece 1 according to this embodiment, the size of the movement 10 can be reduced.

Because the second barrel 31 is disposed between the first barrel 21 and the planetary gear mechanism 60 when the movement 10 is seen in plan view in the axial direction of the first barrel arbor 23 and second barrel arbor 33, the sectional layout and the plan view layout of the movement 10 are more efficient. The first barrel 21, second barrel 31, and planetary gear mechanism 60 are parts with a relatively large thickness in the movement 10, but because these parts are disposed to not overlap each other in plan view, the thickness of the movement 10 can be suppressed.

Because the first planetary transmission wheel 72, barrel planetary transmission wheel 73, second planetary transmission wheel 74 of the winding indicator wheel train 71 that are superimposed with the second barrel 31 in plan view are disposed to not overlap each other, the thickness of the movement 10 can be further suppressed.

Furthermore, because the first barrel 21 and second barrel 31 are disposed on one area of the main plate 11 divided into two parts in the axial direction of the winding stem 41, that is, in the area on the 12:00 side, the generator 80 can be located in the other area, or more specifically in the area on the 6:00 side. As a result, an electronically controlled mechanical timepiece that is powered by a first spring 20 and a second spring 30, operates a rotation control circuit by power generated by a generator 80, adjusts rotation of the generator 80, or more specifically the rotational speed of the wheel train 90, and can move the hour hand 4A, minute hand 4B, and second hand 4C smoothly with great precision, can be provided.

Furthermore, because the timepiece 1 has two springs, the first spring 20 and the second spring 30, a movement 10 with a long duration time can be provided while reducing the plane size. More specifically, because the movement 10 has a center wheel 92 to which the minute hand 4B is attached, and a fourth wheel 94 to which the second hand 4C is attached, in the plane center, the area where the first barrel 21 and second barrel 31 can be disposed is an area toward the outside circumference from the plane center of the main plate 11. Therefore, to increase the duration time using a single spring, the diameter of the barrel must be increased and the plane size of the movement 10 therefore also increases.

However, because the timepiece 1 according to this embodiment of the disclosure has two springs, a first spring 20 and a second spring 30, the plane size of the movement 10 can be reduced compared with a configuration in which the same duration time is provided by a single spring.

Furthermore, because the first barrel 21 in which the first spring 20 is housed is disposed to the 1:00 to 2:00 side of the dial 3 in plan view, the first barrel 21 can be disposed near the manual winding mechanism 40. As a result, the number of wheels in the manual winding mechanism 40 can be suppressed, and a more efficient layout can be achieved.

In addition, because the diameter of the first barrel 21 is smaller than the diameter of the second barrel 31, a button switch can be disposed nearby. As a result, the same movement 10 can be used in multifunction timepiece configurations having a chronograph function and requiring more buttons.

Other Embodiments

The disclosure is not limited to the embodiments described above, and can be modified and improved in many ways without departing from the scope of the accompanying claims.

Figure 9:
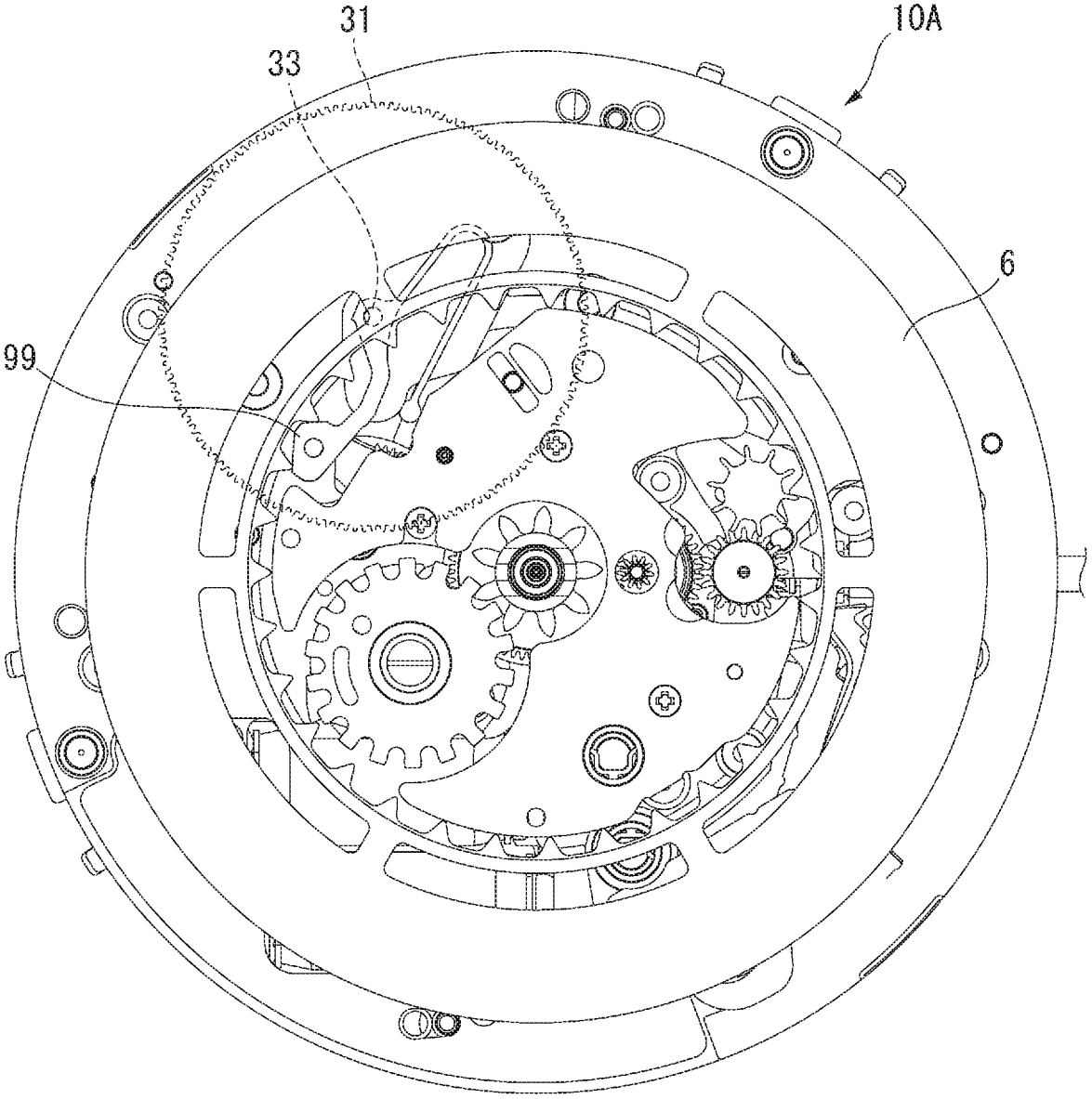
FIG. 9 is a plan view showing main parts of the movement of a timepiece according to another embodiment.

In the embodiment described above the second barrel arbor 33 of the second barrel 31 is also used as the pivot of the barrel planetary transmission wheel 73, but may also be used as a pivot for other parts. For example, in the movement 10A shown in FIG. 9, the dial side end of the second barrel arbor 33 protrudes from the main plate 11, and the second barrel arbor 33 is used as the pivot of the barrel planetary transmission wheel 73 and as a pivot member for the date jumper 99. By thus using the second barrel arbor 33 as the pivot of the barrel planetary transmission wheel 73 and as the pivot member of the date jumper 99, there is no need for another pivot member 100, the layout is more efficient, and cost can be reduced.

Parts axially supported by the second barrel arbor 33 of the second barrel 31 are not limited to the date jumper 99, and other members may be supported.

The timepiece 1 according to this embodiment is also not limited to an electronically controlled mechanical timepiece having a generator 80 and a wheel train 90, and may be a mechanical timepiece having an anchor or other type of regulator, or other type of timepiece having a movement 10 with two springs, first spring 20 and second spring 30.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece comprising:

a first barrel including a first barrel arbor, a first spring, and a first barrel wheel;

a second barrel including a second barrel arbor, a second spring, and a second barrel wheel, disposed to a position not superimposed with the first barrel in a plan view from the axial direction of the first barrel arbor and the second barrel arbor, and having rotation of the first barrel transferred thereto;

a first ratchet wheel that turns in unison with the first barrel arbor;

a planetary gear mechanism having a display pivot that turns in a first direction when rotation of the first ratchet wheel is transferred, and turns in a second direction opposite the first direction when rotation of the second barrel wheel is transferred, and is disposed to a position not superimposed with the first barrel and the second barrel in plan view; and a power reserve wheel train including multiple wheels that transfer rotation of the first ratchet wheel to the planetary gear mechanism, and having one of the multiple wheels axially supported by the second barrel arbor.

2. The timepiece described in claim 1, wherein:

the planetary gear mechanism includes a first sun wheel including the display pivot, and a first sun gear that rotates in unison with the display pivot, a second sun wheel of which the pivot is the display pivot, and which has a second sun gear to which rotation of the first ratchet wheel is transferred, and a second sun pinion that rotates in unison with the second sun gear, an intermediate planetary gear of which the pivot is the display pivot and to which rotation of the second barrel wheel is transferred, a planetary gear that is supported pivotably to the intermediate planetary gear on a pivot disposed eccentrically to the pivot of the intermediate planetary gear, and meshes with the second sun pinion, and a planetary pinion that meshes with the first sun gear; and the power reserve wheel train including a winding indicator wheel train having multiple wheels that transfer rotation of the first ratchet wheel to the second sun gear, one of the multiple wheels supported by the second barrel arbor, and an unwinding indicator wheel train including multiple wheels that transfer rotation of the second barrel wheel to the intermediate planetary wheel.

3. The timepiece described in claim 1, wherein:

the second barrel arbor is also used as a pivot of a part other than the one of the multiple wheels.

4. The timepiece described in claim 1, wherein:

the second barrel is disposed between the first barrel and the planetary gear mechanism.

5. The timepiece described in claim 1, wherein:

the power reserve wheel train includes multiple wheels disposed superimposed in plan view with the first barrel or the second barrel, and not superimposed with each other in plan view.

6. The timepiece described in claim 1, further comprising:

a main plate that axially supports the first barrel arbor and the second barrel arbor; and a winding stem disposed freely rotatably to the main plate;

the first barrel and the second barrel being disposed in one of two areas of the main plate divided in plan view along the axial direction of the winding stem.

7. The timepiece described in claim 6, further comprising:

a wheel train that is driven by the second barrel wheel; and a generator that is driven by the wheel train produces induced electromotive force, and outputs electrical energy;

the generator being disposed in the other of the two areas of the main plate divided in plan view along the axial direction of the winding stem.

* * * * *